US008397408B2

(12) United States Patent
Stancer, III

(10) Patent No.: US 8,397,408 B2
(45) Date of Patent: Mar. 19, 2013

(54) SIGN DISPLAY ASSEMBLIES

(75) Inventor: Fred C. Stancer, III, Randolph, WI (US)

(73) Assignee: Universal Presentation Concepts, Madison, WI (US)

( * ) Notice: Subject to any disclaimer, the term of this patent is extended or adjusted under 35 U.S.C. 154(b) by 252 days.

(21) Appl. No.: 12/706,778

(22) Filed: Feb. 17, 2010

(65) Prior Publication Data

US 2010/0205841 A1 Aug. 19, 2010

Related U.S. Application Data

(60) Provisional application No. 61/153,016, filed on Feb. 17, 2009.

(51) Int. Cl.
*G09F 15/00* (2006.01)

(52) U.S. Cl. ..... 40/607.14; 40/611.12

(58) Field of Classification Search ..... 40/606.18, 40/607.14, 611.12, 649, 658, 666; 24/460, 24/462; 52/846, 836, 781, 773, 775, 511, 52/285.3, 222, 38

See application file for complete search history.

(56) References Cited

U.S. PATENT DOCUMENTS

| | | | | |
|---|---|---|---|---|
| 1,551,880 | A * | 9/1925 | Holman | 248/468 |
| 4,881,707 | A | 11/1989 | Garfinkle | |
| 5,682,698 | A | 11/1997 | Bevins | |
| 5,799,428 | A | 9/1998 | Poindexter | |
| 5,806,823 | A | 9/1998 | Callas | |
| 6,477,744 | B1 * | 11/2002 | Miles | 24/3.12 |
| 6,546,658 | B2 * | 4/2003 | Pitcher et al. | 40/658 |
| 7,065,912 | B2 | 6/2006 | Pitcher | |
| 7,219,458 | B2 * | 5/2007 | Burlando | 40/607.12 |
| 2004/0255499 | A1 * | 12/2004 | Kirschhoffer et al. | 40/658 |

* cited by examiner

*Primary Examiner* — Joanne Silbermann

(74) *Attorney, Agent, or Firm* — Charles S. Sara, Esq.; Daniel A. Blasiole; DeWitt, Ross & Stevens, S.C.

(57) ABSTRACT

Sign display devices are described herein. The sign display devices comprise panel assemblies for attaching to beams and attachment assemblies for attaching to signs. The panel assemblies include a front panel, two side panels, and, optionally, rear panels. The attachment assemblies include various combinations of clip assemblies, C-channel assemblies, and extension assemblies. The display device can be used to display signs in retail establishments to advertise the goods situated on shelving units.

22 Claims, 2 Drawing Sheets

SIGN DISPLAY ASSEMBLIES

CROSS REFERENCE TO RELATED APPLICATIONS

This application claims priority under 35 USC §119(e) to U.S. Provisional Patent Application 61/153,016 filed Feb. 17, 2009, the entirety of which is incorporated herein by reference.

FIELD OF THE INVENTION

The present invention is directed to sign display devices with panel assemblies for attaching to beams or the like and attachment assemblies for attaching to signs or the like.

BACKGROUND

Signs and display cards are used frequently in commercial stores and retail establishments to indicate the location of goods, prices, etc. The signs are displayed on posts, walls, or fixtures via a sign holder.

Sign holders of various forms are known in the art. These include the sign holders described by U.S. Pat. No. 5,682,698 to Bevins; U.S. Pat. No. 4,881,707 to Garfinkle; U.S. Pat. No. 7,065,912 to Pitcher; U.S. Pat. No. 5,806,823 to Callas; and U.S. Pat. No. 5,799,428 to Poindexter.

The sign holders described in these patents, however, do not permit simultaneously displaying a plurality of signs to allow an individual to obtain information about the goods from a variety of positions and angles relative to the goods.

SUMMARY OF THE INVENTION

The current invention provides sign display devices that include a panel assembly and one or more attachment assemblies.

One version of the panel assembly includes a front panel and at least two side panels attached to the front panel, wherein the front panel and the side panels are arranged in a form of a bracket capable of reversibly attaching to a beam. In some versions of the invention, the panel assembly further comprises a back panel attached to each of the side panels, wherein the back panels define a rear gap therebetween. The rear gap permits attachment of the sign display device to a beam.

Attachment assemblies that may be attached to the panel assembly include a clip assembly, a C-channel assembly, and an extension assembly. The attachment assemblies preferably extend the length of the panel assembly.

One version of the clip assembly includes a clip attached to the panel assembly that extends alongside the panel assembly, a cavity defined by the clip and the panel assembly, and a gap between an end of the clip and the panel assembly that provides access to the cavity. Some versions of the clip assembly include a foot member on the clip that is oriented substantially parallel to a panel of the panel assembly. Other versions of the clip assembly include a foot member on the clip that is oriented toward where the clip attaches to the panel assembly. Yet other versions of the clip assembly include a protrusion extending from the panel assembly into the cavity. The clip assembly preferably provides at least four distinct areas of contact with a sign inserted within the clip assembly for securing the clip therein.

One version of the C-channel assembly includes a pair of opposed rails attached to the panel assembly that extend toward each other to define opposed slots between the rails and the panel assembly. Some versions of the C-channel assembly include foot members on the opposed rails, wherein the foot members are substantially parallel to a panel of the panel assembly.

One version of the extension assembly includes a pair of substantially parallel extensions extending from the panel assembly to define an extension slot. The extensions may extend from a panel of the panel assembly at an angle of about 10°, about 20°, about 30°, about 40°, about 45°, about 50°, about 60°, about 70°, about 80°, or about 90°.

The invention further provides sign display devices having various combinations of attachment assemblies on the panel assemblies. One combination includes a first clip assembly on a first of the two side panels, a second clip assembly on a second of the two side panels, and a C-channel assembly on the front panel. Another combination includes a first clip assembly on a first of the two side panels, a second clip assembly on a second of the two side panels, and an extension assembly on the front panel.

The sign display devices described herein are preferably comprised of a flexible, resilient material to facilitate easily but securely attaching the panel assemblies to beams and attaching signs to the attachment assemblies.

The objects and advantages of the invention will appear more fully from the following detailed description of the preferred embodiment of the invention made in conjunction with the accompanying drawings.

DETAILED DESCRIPTION OF THE INVENTION

Figure 1:
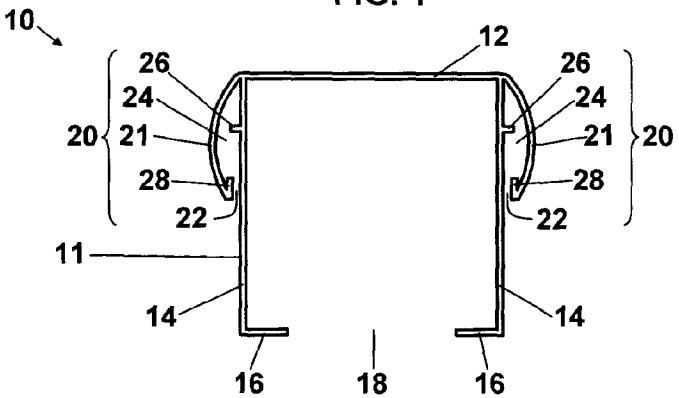
FIG. 1 depicts a top plan view of a sign display device of the current invention including a panel assembly and a clip assembly.

Exemplary versions of the sign display device 10 of the present invention are depicted in FIGS. 1-6. The sign display device 10 includes a panel assembly 11, including a front panel 12 attached to at least two side panels 14. The front panel 12 and side panels 14 are arranged in the form of an elongated bracket (FIGS. 4-6) capable of reversibly attaching to a support beam or the like. For attaching to an elongated cuboidal beam, the panels are flat, and the front panel 12 is arranged orthogonally with respect to the two opposed side panels 14 (as shown). For attaching to a cylindrical beam, the front panel 12 and side panels 14 may embody a curvature and form a continuous, C-shaped configuration for wrapping around the beam. It is preferable that the front panel 12 and side panels 14 in the C-shape configuration extend around at least one-half the circumference of the cylindrical beam. For reversibly attaching to a beam having a specific cross-sectional shape other than those mentioned above (e.g., a beam having a triangular profile, etc.), the side panels 14 may be oriented relative to the front panel 12 in any suitable angle.

The sign display device 10 may also have more than two side panels 14 for attachment to beams having more than four sides.

The front panels 12 and/or the side panels 14 may include gripping components for facilitating a firm attachment to a beam. The gripping components may include a rubber portion on the portions of the front panels 12 and/or side panels 14 facing the beam. The rubber portion may be smooth or textured. Alternatively, the surfaces of the front panels 12 and/or side panels 14 contacting the beam may be textured.

The sign display device 10 may further include back panels 16 attached to the side panels 14. The back panels 16 extend from the side panels 14 and oppose each other to wrap around a rear portion of a beam to secure the sign display device 10 to the beam. The back panels 16 preferably define a rear gap 18 to permit engagement and disengagement of the sign display device to the beam. For attaching the sign display device 10 to an elongated cuboidal beam, the back panels 16 extend orthogonally from the side panels 14 and are parallel to the front panel 12. The back panels 16 may be oriented at other angles relative to the front panels 12 or side panels 14 to accommodate beams having other shapes.

The sign display device 10 is preferably extended in length (see FIGS. 4-6) but is not limited to any specific length. The sign display device 10 may have a length sufficient to span an entire length of a beam or only a portion thereof.

The sign display device 10 includes at least one attachment assembly for detachably securing a sign to the sign display device 10. The various attachment assemblies described herein include clip assemblies 20, C-channel assemblies 30, and extension assemblies 40.

Figure 4:
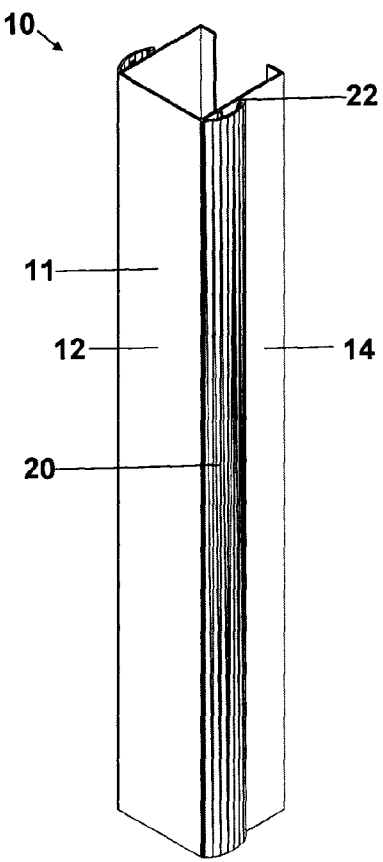
FIG. 4 depicts a perspective view of the sign display device shown in FIG. 1.

FIGS. 1 and 4 show an exemplary sign display device 10 including a clip assembly 20. The clip assembly 20 is configured to slidably engage a sign or the like against a panel 12,14,16 of the sign display device 10. In the exemplary version, the clip assembly 20 includes a clip 21 attached to the side panel 14 and extending alongside the side panel 14 in a manner that defines a gap 22 leading to a cavity 24 (FIG. 1). In other versions, the clip 21 may attach to any portion of the sign display device 10 and may extend alongside any panel 12,14,16 or portion thereof, such as the front panel 12 or rear panel 16, as long as it defines a gap 22 and a cavity 24. The exemplary clip 21 comprises a consistent curvature from its point of attachment to the sign display device 10 to the end of the clip 21 defining the gap 22. The surface of the clip 21 opposite the cavity 24 may be textured.

The clip 21 may be comprised of either a flexible material having spring-like qualities or a rigid material. In either case, but especially in the latter case, the clip 21 may be attached to the panel 12,14,16 via a spring-loaded hinge. The spring-like qualities and/or the spring-loaded hinge attachment enables the gap 22 to be opened to accommodate a sign within the cavity 24 and to close the gap 22 and compress the sign against the panel 12,14,16. The spring-like qualities of the swing arm 20 may be pre-set to define a gap 22 of any size to accommodate signs having various thicknesses. To accommodate even the thinnest of signs, the gap 22 may be configured such that the clip 21 contacts the panel 12,14,16 when a sign is not inserted therein.

In the exemplary version shown in FIG. 4, the sign display device 10 includes one clip assembly 20 per side panel 14 that extends the length of the side panel 14 and spanning approximately half the width of the side panel 14. However, the sign display device 10 may include one or more individual clip assemblies 20, each spanning only a portion of the length of the panel 12,14,16 and taking the form of individual, discrete clips along the length of the panel 12,14,16. In addition, the clip assemblies 20 may span less than half the width of the panel 12,14,16, such as ⅓ or ¼ the width of the panel 12,14,16, or they may span greater than half the width of the panel 12,14,16, such as ⅔, ¼, or the entire width of the panel 12,14,16.

As shown in FIGS. 1 and 4, the clip assembly 20 in the exemplary version is oriented such that the gap 22 is directed away from the front panel 12. In such a configuration, a sign would be engaged by sliding it along the side panel 14 from the rear portion to the front portion of the side panel 14. The sign in this version would extend beyond the back of the sign display device 10 and the beam to which it is attached. A clip 21 may also be oriented such that the gap 22 is directed toward the front panel 12. In such a configuration, a sign would be engaged by sliding it along the side panel 14 from a front portion to a rear portion of the side panel 14. The sign in this version would extend beyond the front of the sign display device 10. The invention is not limited by the orientation of the clip on the panel 12,14,16.

The clip assembly 20 may further include a protrusion 26 extending from the panel 12,14,16 into the cavity 24 defined by the clip 21. In the exemplary version of the invention shown in FIGS. 1 and 4, a protrusion 26 extends from the side panels 14. The protrusion 26 facilitates compression of a sign between the clip 21 and the panel 12,14,16. In a preferred version of the invention, the protrusion 26 is coordinately configured with the gap 22 such that the protrusion 26 extends into the cavity 24 a distance at least equal to a distance defined by the gap 22. As with the clip 21, the protrusion 26 may span the entire length of the panel 12,14,16 from which it extends or may be included only in select regions thereof. In the latter case, multiple protrusions 26 may be included along the length of the panel 12,14,16.

In versions of the clip assembly 20 containing a protrusion 26 and a clip 21 embodying a curvature, as shown in FIGS. 1 and 4, the sign display device 10 provides at least four discrete areas of contact with a sign to provide a secure attachment of the sign. A first area of contact occurs with an end of the clip 21 opposite its point of attachment, i.e., the end defining the gap 22; a second area of contact occurs with a portion of the panel 12,14,16 opposed by the end of the clip 21 defining the gap 22 (i.e., the portion of the panel 12,14,16 proximal the gap 22); a third area of contact occurs with the protrusion 26; and a fourth area of contact occurs with an inner portion of the clip 21 proximal to its point of attachment. These four discrete areas of contact are particularly useful for securing signs having a rigid or semi-rigid structure to the sign display device 10. The areas of contact may be increased beyond four in cases in which multiple, individual protrusions 26 are linearly arranged along the length of the panel 12,14,16. The areas of contact may include gripping components, such as a textured surface or a smooth or textured rubber pad to increase the friction among the areas of contact and the sign.

In the exemplary version shown in FIGS. 1 and 4, the clip assembly 20 includes a foot member 28. The foot member 28 is an extended member at the end of the clip 21 opposite the point of attachment of the clip 21 to the panel 12,14,16 (i.e., the end defining the gap 22). In a preferred version, the foot member 28 is oriented toward the point of attachment of the clip 21 to the panel 12,14,16 and is substantially parallel to the panel 12,14,16. The foot member 28 adds to the amount of surface area of the clip 21 that contacts a sign to secure the sign to the panel 12,14,16. The foot member 28 also serves as one of the four areas of contact to compress a sign against the panel 12,14,16. The foot member 28 may include gripping components, such as a textured surface or a smooth or textured rubber pad to increase the friction with a sign.

Figure 2:
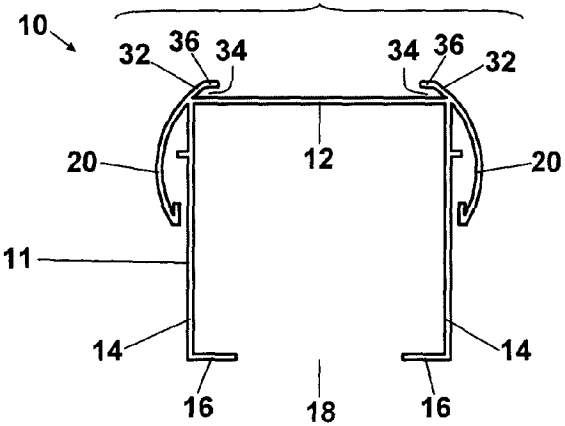
FIG. 2 depicts a top plan view of a sign display device of the current invention including a panel assembly, a clip assembly, and a C-channel assembly.
Figure 5:
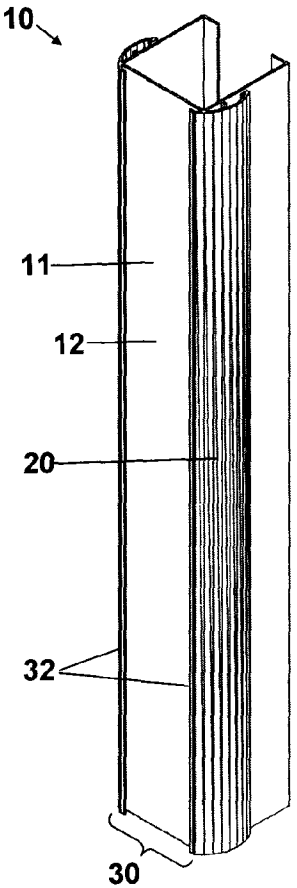
FIG. 5 depicts a perspective view of the sign display device shown in FIG. 2.

A second exemplary attachment assembly is a C-channel assembly 30, shown in FIGS. 2 and 5. The C-channel assembly 30 is formed by the combination of opposed rails 32 extending from a panel 12,14,16. Each rail 32 extends in a direction towards the opposing rail 32 to define a slot 34 between the rail 32 and the panel 12,14,16. The rails 32 preferably include a foot member 36, wherein the foot member 36 is an extended portion of the rail 32 substantially parallel to the panel 12,14,16. The C-channel assembly 30 secures a sign to the sign display device 10 by holding a sign within the slots 34 defined by the opposed rails 32. The sign may be inserted within the C-channel assembly 30 by sliding the sign into the C-channel assembly 30 from either a top end or a bottom end of the C-channel assembly 30. Alternatively, a first edge of the sign may be inserted into a first of the two opposed slots 34, followed by momentarily deforming the sign to insert a second edge of the sign into a second of the two opposed slots 34. The slots 34 are sized to produce a friction fit of the sign therein, such that the sign may slide within the slots 34 with direct pressure but otherwise remains suspended therefrom. Alternatively, the slots 34 provide a loose fit and include stops (not shown) extending from the panel 12,14,16 at the lower-most portion of the C-channel assembly 30 to prevent the sign from sliding beyond the bottom of the C-channel assembly 30.

In the exemplary version of the invention shown in FIG. 5, the C-channel assembly 30 spans the entire length of the front panel 12, and the rails 32 are separated across the entire width of the front panel 12. However, the invention allows for the rail 32 to span only a portion of the length of the panel 12,14,16 and to be separated across only a portion of the width of the panel 12,14,16. Furthermore, the invention also allows for multiple C-channel assemblies 30 to be distributed along the length of the panel 12,14,16. Finally, the C-channels may be attached to any panel 12,14,16.

Figure 3:
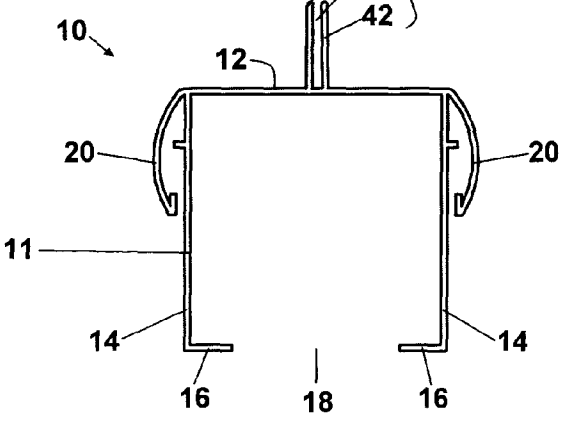
FIG. 3 depicts a top plan view of a sign display device of the current invention including a panel assembly, a clip assembly and an extension assembly.
Figure 6:
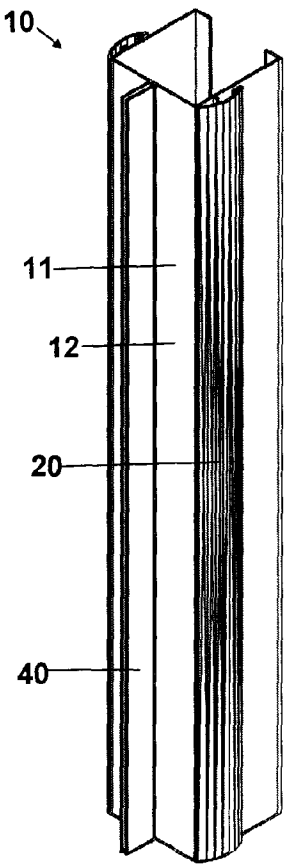
FIG. 6 depicts a perspective view of the sign display device shown in FIG. 3.

A third exemplary attachment assembly is an extension assembly 40, as shown in FIGS. 3 and 6. The extension assembly 40 includes a pair of substantially parallel extensions 42 that extend from the panel 12,14,16 and define an extension slot 44. In the exemplary version shown in FIGS. 3 and 6, the extensions 42 extend substantially perpendicularly from the front panel 12. However, the extensions 42 may extend from the panel 12,14,16 at any angle relative to the panel 12,14,16, such as about 10°, about 20°, about 30°, about 40°, about 45°, about 50°, about 60°, about 70°, about 80°, or about 90° relative to the panel 12,14,16, as long as the extensions 42 are oriented substantially parallel to each other. The term "about" in this context designates +/−5°. The extensions 42 secure a sign to the sign display device 10 by holding a sign within the extension slot 44 such that the sign extends therefrom. The extension slot 44 is sized to produce a friction fit of the sign therein, such that the sign may slide within the slots 44 with direct pressure and otherwise remains suspended therefrom.

In an exemplary version shown in FIG. 5, the extensions assembly 40 extends the entire length of the front panel 12 along the center of the front panel 12. However, the invention allows for the extensions 42 to extend over only a portion of the length of the panel 12,14,16 and to be placed anywhere across the width of the panel 12,14,16. Furthermore, the invention also allows for multiple extension assemblies 40 to be distributed along the length of the panel 12,14,16.

The sign display device 10 may include any arrangement of the panel assemblies 11 and attachment assemblies described or suggested herein. For example, the sign display device 10 may include at least one, at least two, at least three, or at least four or more attachment assemblies on the panel assembly. Such attachment assemblies may be the same type of attachment assembly or different types. The sign display device 10 may include one of each attachment assembly described herein or different combinations or sub-combinations thereof. Exemplary versions of the sign display device 10 with various combinations of attachment assemblies are shown in FIGS. 1-6.

FIGS. 1 and 4 show a sign display device 10 with a panel assembly 11 and a clip assembly 20. As shown in detail in FIG. 1, the panel assembly 11 includes a front panel 12, two opposed side panels 14 oriented orthogonally to the front panel 12, and back panels 16 orthogonal to the side panels 14 and parallel to the front panel 12. The back panels 16 define a rear gap 18 for attachment to a beam. The clip assembly 20 includes clips 21 disposed on each of the side panels 14 that extend the entire length of the side panels 14, wherein the clips 21 embody a curvature, define a cavity 24 and a gap 22, and include a foot member 28. The clip assembly 20 in this version also includes a protrusion 26 placed within the cavity 24 defined by the clips 21. This version of the sign display device 10 reversibly attaches to a beam and permits suspending signs therefrom by attaching signs to the clips 21 disposed on the side panels 14. The signs in this version would face sideways relative to the sign display device 10 and extend in a rearward direction behind the sign display device 10 and the beam to which the sign display device 10 is attached.

FIGS. 2 and 5 show a sign display device 10 with a panel assembly 11, a clip assembly 20, and a C-channel assembly 30. The panel assembly 11 and the clip assembly 20 are as described above for FIGS. 1 and 4. The C-channel assembly 30 includes opposed rails 32 extending the entire length of the front panel 12 and defining opposed slots 44. The rails 32 on the front panel 12 and the clips 21 on the side panels 14 both embody a curvature continuous with each other, with the exception of the foot members 28 on the clips 21 and the foot members 36 on the rails 32. The rail/clip 32/21 combinations are attached to the panel assembly 11 at a common portion of the panel assembly 11, namely, the corners defined by the interface between the front panel 12 and each of the side panels 14. In addition to attaching to a beam and displaying a sign along the side panels 14 as described for FIGS. 1 and 4, the version shown in FIGS. 2 and 5 permits securing a sign flush against the front panel 12 such that it faces forward relative to the sign display device 10 and the beam to which the sign display device 10 is attached.

FIGS. 3 and 6 show a sign display device 10 with a panel assembly 11, a clip assembly 20, and an extension assembly 40. The panel assembly 11 and the clip assembly 20 are as described above for FIGS. 1 and 4. The extension assembly 40 includes a pair of extensions 42 defining an extension slot 44, both extensions 42 extending perpendicularly from the front panel 12 and disposed about midway across the width of the front panel 12. This version of the sign display device 10 permits reversible attachment to a beam and display of a sign along the side panels 14 as described for FIGS. 1 and 4. In addition, it permits inserting a sign within the extension slot 44. Such a sign would extend in a forward direction from the sign display device 10 and the beam to which the sign display device 10 is attached and face sideways relative to the sign display device 10.

The sign display device 10 can have a unitary construction comprising a single material or may be comprised of a plurality of materials. The sign display device 10 may be formed of any folded sheet material but is generally formed of an extruded plastic or metal or plastic/metal combination. The material comprising the sign display device 10 is preferably a flexible, resilient material such as a plastic. A flexible, resilient material permits flexure of the panel assembly 11 while attaching to a beam, followed by retraction of the panel assembly 11 to its original conformation after attachment. A flexible, resilient material further permits flexure of the clip assemblies 20, C-channel assembly 30, or extension assembly 40 during attachment of signs thereto, followed by retraction of such attachment assemblies for securing a sign thereto with a friction fit.

Exemplary dimensions for at least one version of the elements of the sign display device 10 described herein are as follows:

| | | |
|---|---|---|
| Panel Assembly 11 | 102-inch | length |
| Front Panel 12 | 3-inch | width |
| Side Panels 14 | 3-inch | width |
| Back Panels 16 | 0.5-inch | width |
| Rear Gap 18 | 2-inch | width |
| Clip Assembly 20 | 102-inch | length |
| Clip 21 | 1.5-inch | span |
| Gap 22 | 0.1-inch | opening |
| Protrusion 26 | 0.125-inch | extension into cavity |
| Foot Member 28 | 0.25-inch | width |
| C-Channel Assembly 30 | 102-inch | length |
| Lips 32 | 0.281-inch | width |
| Slot 34 | 0.125-inch | opening |
| Foot Member 36 | 0.281-inch | width |
| Extension Assembly 40 | 102-inch | length |
| Extensions 42 | 1.035-inch | width |
| Extension Slot 44 | 0.1-inch | opening |

The width, span, extension, and opening dimensions described above refer to the elements as shown in the top plan views of FIGS. 1-3. The length dimensions described above refer to the extended axis as shown the perspective views of FIGS. 4-6. The length, width and other measurements of the sign display device 10 may be changed as necessary depending upon the dimensions of the beams and signs to be used in conjunction with the sign display device 10.

The display device 10 may attach to beams on shelving units in retail establishments, such as hardware stores, department stores and the like, to display signs. The signs may advertise the goods situated on shelving units adjacent to beams. The sign display device 10 may attach to a beam oriented in any direction, whether oriented horizontally, vertically, or at an oblique angle. In a preferred version, the sign display device 10 attaches to the vertical front beams supporting shelving units in a retail establishment. Attachment of signs to the rearward-facing clips 21 on side panels 14 of sign display devices 10 provides a barrier of the goods on either side of the beam. The information on the sign attached to the rearward-facing clips 21 can provide information specific to the particular goods confined to the space on either side of the beam. Signs attached to forward-facing extension assemblies 40 on the front panel 12 of sign display devices 10 would extend into the aisle of a retail establishment to provide information about the type of goods contained in the aisle and their location within the aisle. A consumer would be able to identify the goods and their locations in an aisle without entering it. The extension assemblies 40 are particularly useful when used in combination with the rearward-facing clips 21 to identify the goods partitioned within the aisle. Unlike signs attached to rearward facing clips 21 on side panels 14 or forward-facing extension assemblies 40 on front panels 12, signs attached to a C-channel assembly 30 on the front panel 12 of a sign display device 10 provide a means of presenting information to an individual standing directly in front of the beam. A combination of a C-channel assembly 30 on the front panel 12 with the rearward-facing clips 21 on side panels 14 are particularly useful for presenting information to an individual at all angles relative to the goods.

The sign display device 10 may be configured to display poster-like signs or signs having edges with a substantially flat profile for inserting into the gap 22, cavity 24, slot 34, and/or the extension slot 44, described herein. Alternatively, the signs may have edges comprising a bump or a ridge that nests within a notch in the clip 21, rails 32, and/or extensions 42, to facilitate securing the sign in the gap 22 and cavity 24, slot 34, and/or extension slot 44, respectively.

Any version of any element of the invention described herein may be used with any other element.

As used in this specification and the appended claims, the singular forms "a," "an," and "the" include plural referents unless the content clearly dictates otherwise. The term "or" is generally employed in its sense including "and/or" unless the content clearly dictates otherwise.

Numerical ranges as used herein are intended to include every number and subset of numbers contained within that range, whether specifically disclosed or not. Further, these numerical ranges should be construed as providing support for a claim directed to any number or subset of numbers in that range. For example, a disclosure of from 1 to 10 should be construed as supporting a range of from 2 to 8, from 3 to 7, 5, 6, from 1 to 9, from 3.6 to 4.6, from 3.5 to 9.9, and so forth.

All patents and publications mentioned herein are expressly incorporated by reference to the same extent as if each individual patent and publication was specifically and individually indicated by reference. In case of conflict between the present disclosure and the incorporated patents or publications, the present disclosure should control.

The elements of the present invention can comprise, consist of, or consist essentially of the essential elements and limitations described herein, as well as any additional or optional limitations described herein or otherwise useful in the art.

It is understood that the invention is not confined to the particular construction and arrangement of parts herein illustrated and described, but embraces such modified forms thereof as come within the scope of the following claims.

The invention claimed is:

1. A sign display device including:

a panel assembly including:

a front panel; and at least two side panels attached to the front panel, wherein the front panel and the side panels are arranged in a form of a bracket comprising an inner portion and an outer portion and capable of reversibly attaching to a beam by the beam nesting within the inner portion, wherein outer faces of each of the at least two side panels and the front panel define the outer portion of the bracket; and a clip assembly including:

a clip attached to the panel assembly and extending alongside the outer face of one of the at least two side panels or the front panel, wherein the entire clip juxtaposes the outer face;

a cavity defined by the clip and the outer face;

a foot member on the clip that is oriented toward where the clip attaches to the panel assembly; and a gap between an end of the clip and the outer face that provides access to the cavity.

2. The sign display device of claim 1 wherein the panel assembly further comprises a back panel attached to each of the side panels, wherein the back panels define a rear gap therebetween.

3. The sign display device of claim 1 wherein the panel assembly is longitudinally extended to define a length and the clip assembly extends the length of the panel assembly.

4. The sign display device of claim 1 wherein the clip embodies a continuous, consistent curvature.

5. The sign display device of claim 1 wherein the foot member on the clip is oriented substantially parallel to the outer face.

6. The sign display device of claim 1 wherein the clip assembly further comprises a protrusion extending from the outer face into the cavity.

7. The sign display device of claim 6 configured to provide at least four distinct areas of contact with a sign inserted within the clip assembly.

8. The sign display device of claim 6 wherein the protrusion extends from the panel assembly at least a distance equal to a distance defined by the gap.

9. The sign display device of claim 1 further comprising an attachment assembly attached to the panel assembly, wherein the attachment assembly is selected from the group consisting of:

a C-channel assembly including a pair of opposed rails attached to the panel assembly and extending toward each other to define opposed slots between the rails and the panel assembly; and an extension assembly including a pair of substantially parallel extensions extending from the panel assembly to define an extension slot.

10. The sign display device of claim 1 wherein the clip extends alongside only a first portion of the outer face such that a second portion of the outer face is outwardly exposed.

11. A sign display device including:

a panel assembly including:

a front panel; and at least two side panels attached to the front panel, wherein the front panel and the side panels are arranged in a form of a bracket comprising an inner portion and an outer portion and capable of reversibly attaching to a beam by the beam nesting within the inner portion, wherein outer faces of each of the at least two side panels and the front panel define the outer portion of the bracket; and at least two attachment assemblies attached to the panel assembly, wherein the attachment assemblies are selected from the group consisting of:

a clip assembly including:

a clip attached to the panel assembly and extending alongside the outer face of one of the at least two side panels or the front panel, wherein the entire clip juxtaposes the outer face;

a cavity defined by the clip and the outer face; and a gap between an end of the clip and the outer face that provides access to the cavity;

a C-channel assembly including a pair of opposed rails attached to the panel assembly and extending toward each other to define opposed slots between the rails and the panel assembly; and an extension assembly including a pair of substantially parallel extensions extending from the panel assembly to define an extension slot wherein the at least two attachment assemblies include at least one C-channel assembly wherein the C-channel assembly further comprises foot members on the opposed rails that are substantially parallel to a panel of the panel assembly.

12. The sign display device of claim 11 wherein the panel assembly further comprises a back panel attached to each of the side panels, wherein the back panels define a rear gap therebetween.

13. The sign display device of claim 11 wherein the panel assembly is longitudinally extended to define a length and the attachment assembly extends the length of the panel assembly.

14. The sign display device of claim 11 further including at least one clip assembly wherein the clip of the clip assembly and one of the rails of the C-channel assembly are attached to the panel assembly at a common portion of the panel assembly.

15. The sign display device of claim 14 wherein the clip and the one of the rails together form a continuous curvature.

16. The sign display device of claim 11 including at least one extension assembly wherein the extensions extend from a panel of the panel assembly at an angle selected from the group consisting of about 10°, about 20°, about 30°, about 40°, about 45°, about 50°, about 60°, about 70°, about 80°, and about 90°.

17. The sign display device of claim 11 wherein a first of the two side panels includes a first clip assembly, a second of the two side panels includes a second clip assembly, and the front panel includes the C-channel assembly.

18. The sign display device of claim 11 wherein a first of the two side panels includes a first clip assembly, a second of the two side panels includes a second clip assembly, and the front panel includes an extension assembly.

19. The sign display device of claim 11 comprised of a flexible, resilient material.

20. The sign display device of claim 11 wherein the clip extends alongside only a first portion of the outer face such that a second portion of the outer face is outwardly exposed.

21. A sign display device including:

a panel assembly including:

a front panel; and at least two side panels attached to the front panel, wherein the front panel and the side panels are arranged in a form of a bracket comprising an inner portion and an outer portion and capable of reversibly attaching to a beam by the beam nesting within the inner portion, wherein outer faces of each of the at least two side panels and the front panel define the outer portion of the bracket; and a clip assembly including:

a clip attached to the panel assembly and extending alongside the outer face of one of the at least two side panels or the front panel, wherein the entire clip juxtaposes the outer face;

a cavity defined by the clip and the outer face;

a foot member on the clip that is oriented substantially parallel to the outer face; and a gap between an end of the clip and the outer face that provides access to the cavity.

22. A sign display device including:

a panel assembly including:

a front panel; and at least two side panels attached to the front panel, wherein the front panel and the side panels are arranged in a form of a bracket comprising an inner portion and an outer portion and capable of reversibly attaching to a beam by the beam nesting within the inner portion, wherein outer faces of each of the at least two side panels and the front panel define the outer portion of the bracket; and at least two attachment assemblies attached to the panel assembly, wherein the attachment assemblies are selected from the group consisting of:

a clip assembly including:

a clip attached to the panel assembly and extending alongside the outer face of one of the at least two side panels or the front panel, wherein the entire clip juxtaposes the outer face;

a cavity defined by the clip and the outer face; and a gap between an end of the clip and the outer face that provides access to the cavity;

a C-channel assembly including a pair of opposed rails attached to the panel assembly and extending toward each other to define opposed slots between the rails and the panel assembly; and an extension assembly including a pair of substantially parallel extensions extending from the panel assembly to define an extension slot, wherein the at least two attachment assemblies include at least one clip assembly and at least one C-channel assembly wherein the clip of the clip assembly and one of the rails of the C-channel assembly are attached to the panel assembly at a common portion of the panel assembly and wherein the clip and the one of the rails together form a continuous curvature.

* * * * *